United States Patent [19]

Wilson et al.

[11] 4,312,279

[45] Jan. 26, 1982

[54] COMPACTOR-FEEDER FOR SOLID WASTE INCINERATOR

[76] Inventors: James C. Wilson, 2420 Thornridge Rd.; C. Conway Wilson, 2509 Fernbank Dr., both of Charlotte, N.C. 28211

[21] Appl. No.: 193,896

[22] Filed: Oct. 6, 1980

[51] Int. Cl.[3] ..... F23G 5/00

[52] U.S. Cl. ..... 110/346; 110/186; 110/193; 110/255; 110/257; 414/187; 414/196

[58] Field of Search ..... 110/223, 255, 257, 346, 110/269, 329, 101 C, 101 CD, 193, 173 R, 184; 414/187, 194

[56] References Cited

U.S. PATENT DOCUMENTS

| | | | |
|---|---|---|---|
| 2,904,195 | 9/1959 | Andersson et al. | 414/196 |
| 3,200,776 | 8/1965 | Simpson | 110/257 X |
| 3,380,408 | 4/1968 | Rivers | 110/257 |
| 3,457,882 | 7/1969 | Ryzika | 110/255 X |
| 3,556,025 | 1/1971 | Holley | 110/257 |
| 3,871,286 | 3/1975 | Henriksen | 110/257 |

FOREIGN PATENT DOCUMENTS

| | | | |
|---|---|---|---|
| 27751 | 3/1931 | Australia | 110/269 |
| 74346 | 5/1932 | Sweden | 414/87 |

*Primary Examiner*—Edward G. Favors
*Attorney, Agent, or Firm*—Richards, Shefte & Pinckney

[57] ABSTRACT

Converging upper and lower conveyors transport loose waste from a receiving hopper toward an incinerator combustion chamber entrance at an adjustably predetermined normal rate, cooperating to compact the waste into a continuous plug and to force the plug through a confining passageway extending from the conveyors to the incinerator entrance, thereby feeding the waste plug to the burning firebed in the combustion chamber at a steady rate for causing waste combustion therein at a generally steady rate while sealing the entrance thereto against incoming air and outgoing heat or fire. The upper conveyor is movable and selectively biased downwardly for waste compaction when the conveyors transport a predetermined normal quantity of waste; but the bias is removed upon transport of an abnormal quantity, and a fire door at the entrance and a firestop spaced therefrom in the passageway are closed on whatever waste may be thereunder for further local compression thereof while the conveyors are reversed to travel at a higher rate to clear themselves if they are transporting a greater than normal quantity and speeded up to travel at the higher rate in feeding direction if transporting a lesser than normal quantity. Transport toward the incinerator is resumed upon clearing, but at the higher rate. The firestop opens, and, thereafter the fire door opens and the normal transport rate resumes upon again transporting a normal quantity of waste. The fire door and firestop also close if the conveyors are shut down, and serve when closed to further seal off the incoming waste from the heat and fire in the incinerator.

52 Claims, 3 Drawing Figures

COMPACTOR-FEEDER FOR SOLID WASTE INCINERATOR

BACKGROUND OF THE INVENTION

Package-unit incinerators are in wide and increasing use for the disposal of combustible solid waste materials due to the shortage of land-fill disposal sites, governmental regulations controlling contaminated waste and air pollution from open burning, energy recovery possibilities from incineration, and ease of disposal by incineration on-site.

For example, hospitals produce relatively large quantities of combustible waste, much of which may be contaminated material, they are usually located where air pollution is particularly objectionable, and they normally have considerable heat requirements which may be supplied from incineration.

Modern package-unit incinerators that can meet current clean air codes operate on the controlled air principal, and they are of the dual chamber type. Partial combustion takes place pyrolitically in the lower primary chamber in a "starved" air or less than stoichiometric atmosphere. Combustion of the unburned gasses from the primary chamber is completed in the upper secondary chamber in an excess air atmosphere.

More and more incinerators of this type in sizes of 1000 lbs/hr and larger are being used in heat recovery systems. In these systems, the hot gas effluent from the burning waste is ducted to a nearby steam boiler, hot water heater or other type of heat exchanger where the energy is utilized.

There are several problems that hamper the operation of these incineration-heat recovery systems. One problem is that the incinerators are generally batch loaded by ram type feeders. Every time a batch or charge is loaded there is an inrush of cold air that upsets the air balance and causes a momentary temperature drop in the primary chamber. Following each newly loaded batch, there is a surge of easily liberated volatiles into the secondary chamber causing a sharp upper chamber temperature rise which subsides gradually until the next charge causes another peak. This tends to cause smoke from the stack and reduced combustions efficiency during the surge part of the cycle. This not only creates unacceptable air pollution, but also results in coating of the heat exchanger tubes causing heat transfer inefficiency and produces undesirable fluctuations and losses in the desired flow of recovered energy. The dwindling supply of gasses to the secondary chamber during each charging cycle also produces a constantly changing fuel-air ratio in a fixed air flow system.

To be safe, combustion air must be supplied to the secondary chamber of such an incinerator in the proper air-fuel ratio to attempt to produce clean burning during the surges. As an economically practical matter, the fluctuating waste gas flow cannot be matched with a proportional air flow that would maintain a fixed air-fuel ratio during the cycles. Therefore, air is supplied in a quantity that is generally adequate for the peak gas flow but is considerably in excess for the reduced gas flow as burning of the charge progresses, so that the temperature drops rapidly as excess air increases, and the average temperature falls far below the temperature of optimum air-fuel ratio burning.

A batch loading system is expensive to automate completely. Therefore, most systems are monitored by an operator who typically delays or completely misses a loading period from time to time. This causes average combustion temperature and therefore the recovered energy flow to fall even farther short of the desired level.

The problems connected with fluctuating waste gas flow to the secondary chamber can be largely eliminated by feeding the waste into the incinerator continuously at the desired burning rate rather than in batches. A great advantage is obtained by the resultant relatively constant flow of waste gas to which the air flow can be matched in a fixed near-optimum ratio to produce more nearly maximum temperature as well as cleaner burning in the secondary chamber.

The compactor-feeder of the present invention is designed to provide a continuous supply of compacted solid waste to a package-unit incinerator or other combustion chambers and is expected to improve the efficiency of converting waste to heat by a 15–20% factor. Compaction of the waste gives the waste enough structural integrity to be pushed into the firebed of the incinerator, and it forms a dense moving plug of compacted waste which forms an effective air seal for the primary incinerator chamber and also prevents heat from the incinerator from prematurely igniting the incoming waste.

Practical continuous feeding becomes feasible with the unique combination of structural features of the presently proposed compactor-feeder which should enable it to automatically respond to an object or quantity of waste which is insufficiently compactable for passage into the incinerator and to a supply of waste insufficient to form a suitably compacted plug, while also having the capability to prevent fire getting to the feed hopper from the incinerator under those conditions, as well as while normally operating, stopping and starting, and shutting down, all with waste combustion in process and the incinerator at operating temperature.

U.S. Pat. Nos. 1,004,126, 1,224,993, 2,351,410, 2,402,849, 3,230,866, and 3,815,521 disclose convergent conveyors for feeding various materials. U.S. Pat. Nos. 1,450,127, 1,463,300, and 2,095,446 disclose doors used in connection with feeding various fuels. U.S. Pat. No. 3,457,882 discloses a plug of waste material used as an air seal. U.S. Pat. Nos. 987,911, 2,792,131, 2,978,997, and 3,473,493 also relate to furnace feeding. None of the above-listed patents discloses or suggests the combination of elements or the methods which are considered to make the present invention patentable, workable and advantageous for feeding waste incinerators.

SUMMARY OF THE INVENTION

Briefly described, the present invention provides a compactor-feeder apparatus for a solid waste incinerator having a waste combustion chamber with a firebed therein and an entrance thereto communicating with the firebed and including a waste receiving hopper having an exit spaced from the combustion chamber entrance; lower conveyor means traversing the bottom of the hopper for transporting waste therefrom through the exit toward the combustion chamber entrance; upper conveyor means disposed above the lower conveyor means and extending convergently with the lower conveyor means toward the combustion chamber entrance for cooperating with the lower conveyor means for compacting the waste and forcing it into the combustion chamber to feed the firebed a continuous plug of compacted waste, the upper conveyor means having a convergent end mounted in spaced relation above the lower conveyor means, and the convergent end being spaced from the combustion chamber entrance to provide a fire break therebetween; an enclosed passageway from the convergent end of the upper conveyor means to the combustion chamber entrance for confining the compacted waste as it is being forced therethrough by the upper and lower conveyor means into the combustion chamber; a movable fire door selectively operable to open and close the combustion chamber entrance; and firestop means disposed at the passageway at a spacing from the combustion chamber entrance and selectively movable in the passageway for opening of the firestop for the compacted waste to be forced through the passageway, and for closing of the firestop against the compacted waste therein with the firestop imposing further concentrated localized compacting thereof, the firestop means being movable to completely close the passageway in the absence of waste therein, the firestop thereby serving to seal the waste in the hopper and between the conveyor means from any combustion occurring in the passageway between the firestop and the fire door.

The present invention may further include means for moving the movable firestop, means for causing opening of the firestop when the conveyor means is transporting a predetermined quantity of waste, and means for causing the conveyor means to travel at a predetermined normal rate after the firestop opening and operable to adjust that rate, the normal rate being suitable for causing combustion of the waste in the combustion chamber at a generally steady rate. Also included is means for causing the firestop means to be closed against the compacted waste for closing off the passageway when the conveyor means is transporting less than a predetermined quantity of waste.

The present compactor-feeder may also include a pressure plate having an end disposed adjacent the upper conveyor means in fixed doctoring relation thereto and forming an upper portion of the enclosed passageway, a floor plate for the passageway disposed in doctoring relation to the lower conveyor between the lower conveyor and the combustion chamber entrance, means for extinguishing fire in the passageway, and a temperature sensor for the passageway for activating the extinguishing means. Further included may be means for selectively causing the movable fire door to move to an open position when the waste is being forced into the combustion chamber and to close under pressure against the compacted waste when the conveyor means stop, operate in reverse, or transport less than a predetermined quantity of waste, the door being movable to completely close the combustion chamber entrance in the absence of waste thereunder. The upper conveyor means may be movable and mounted for movement of at least its convergent end toward and away from the lower conveyor means and means may be provided for biasing the upper conveyor means downwardly for compacting the waste thereunder, the biasing means being included in the means for moving the firestop. Means may also be provided for selectively engaging the biasing means with the upper conveyor for compacting the waste.

Preferably, the present compactor-feeder includes means for causing the firestop opening and the engaging and biasing when the conveyor is transporting the aforesaid predetermined quantity of waste and means for causing the conveyor to travel at a predetermined normal rate after such engaging and biasing. The means for moving the firestop may further include means for selectively positioning the firestop open and closed against the compacted waste and means for causing the biasing means to disengage from the upper conveyor and the firestop to be closed against the compacted waste for closing off the passageway when the conveyor means is transporting less than the predetermined quantity of waste.

The preferred embodiment of the present invention includes reversing means for causing the conveyor means to reverse and travel in reverse at a predetermined relatively high rate in response to upward movement to a predetermined position of the upper conveyor means caused by transport of a quantity or object of waste insufficiently compactable by the biasing for suitable passage through the apparatus into the combustion chamber, thereby clearing the conveyor means of the quantity or object sufficiently to allow the upper conveyor means to move downwardly from the predetermined position; and means for causing the biasing means to disengage from the upper conveyor means and causing the firestop means to be closed against the compacted waste for closing off the passageway in response to the aforesaid upward movement, the reversing means including means for causing the conveyor means to again travel in feeding direction upon the aforesaid clearing, and the apparatus including means for again causing the firestop opening and the engaging and biasing upon the aforesaid clearing, the clearing being sufficient to end the response.

The present invention includes a method of generally continuously feeding waste from a hopper to the firebed of a waste combustion chamber for combustion therein and preventing fire from reaching the hopper including the steps of transporting a predetermined normal quantity of the waste from the hopper toward the combustion chamber and compacting the waste during the transporting, the transporting normally forcing the compacted waste through a confining passageway to an entrance to the combustion chamber as a continuous plug of compacted waste, thereby sealing the entrance and preventing fire from the combustion chamber from reaching the waste in the hopper during the feeding; detecting a discontinuance of the transporting of the normal waste quantity; closing a firestop on the plug in the passageway at a distance from the combustion chamber entrance in response to the detecting; and closing a fire door on the plug at the combustion chamber entrance in response to the detecting, the firestop and fire door closing causing further localized compacting of the plug under the firestop and fire door for preventing fire from passing beyond the firestop in the direction of the hopper during such discontinuance.

The present method is further characterized in that the transporting occurs at a first predetermined rate of travel which is adjustable and is adjusted for a generally steady rate of such combustion, and in that the firestop and fire door closing occur upon transporting of less than the predetermined normal quantity of waste. Further steps may include transporting waste from the hopper toward the combustion chamber at a second higher rate of travel upon such transport of less than the predetermined normal quantity of waste, opening the firestop from the plug upon again transporting the predetermined normal quantity of waste after such closings, and opening the fire door from the plug and reverting to transporting the waste at the first rate of travel at a predetermined time after such opening of the firestop.

The present method of feeding waste may be characterized further in that the transporting occurs at a first predetermined rate of travel and that the firestop and fire door closings occur upon detecting a discontinuance as aforesaid which includes transporting of a quantity or object of waste insufficiently compactable for normal forcing through the passageway, and may include an additional step of reversing the direction of the transporting upon detecting the transporting of the insufficiently compactable waste, the firestop and fire door closings preventing dragging of burning waste from the combustion chamber by such reversing. Such reverse tranporting occurs at a higher rate of travel than the first predetermined rate and continues until the insufficiently compactable waste is cleared from such detecting, such clearing being followed by a step of again transporting the waste toward the combustion chamber, but at a second rate of travel higher than the first predetermined rate. Additional steps may include opening the firestop from the plug upon transport of the predetermined normal quantity of waste again after the closings, opening the fire door from the plug and reverting to transporting the waste at the first rate of travel at a predetermined time after the opening of the firestop, continuing repetition of the four steps just mentioned until the incompactable waste is removed or the repetition causes suitable compaction of the previously incompactable waste for resumption of the transporting of the normal quantity, and sounding an audible alarm during the reverse direction transporting.

Preferably the method of the present invention includes steps of shutting down the transporting and closing the firestop and fire door against the compacted waste; briefly reversing the transporting prior to restarting transporting toward the combustion chamber after such shutting down thereof, to allow time for the firestop and fire door to be respectively opened before again transporting the compacted waste plug respectively therepast after the restarting; and briefly reversing the transporting after the shutting down thereof, when the shutting down is intended for a prolonged period, for dragging at least part of the compacted waste plug from the vicinity of the firestop for more effectively preventing fire from the combustion chamber from reaching the waste in the hopper during the period of shutdown by disrupting the continuous plug of waste and allowing farther closing of the firestop. The preferred method of feeding waste to a combustion chamber according to the present invention includes steps of detecting fire in the passageway by means for monitoring the temperature therein and extinguishing such fire through actuation by the monitoring means of fire extinguishing means located in the passageway. The preferred method is further characterized in that the compacting is done under predetermined bias, and the firestop and fire door closings occur upon detecting a discontinuance as aforesaid including transporting of a quantity or object of waste insufficiently compactable under such bias for normal forcing through the passageway.

DESCRIPTION OF THE PREFERRED EMBODIMENT

Figure 1:
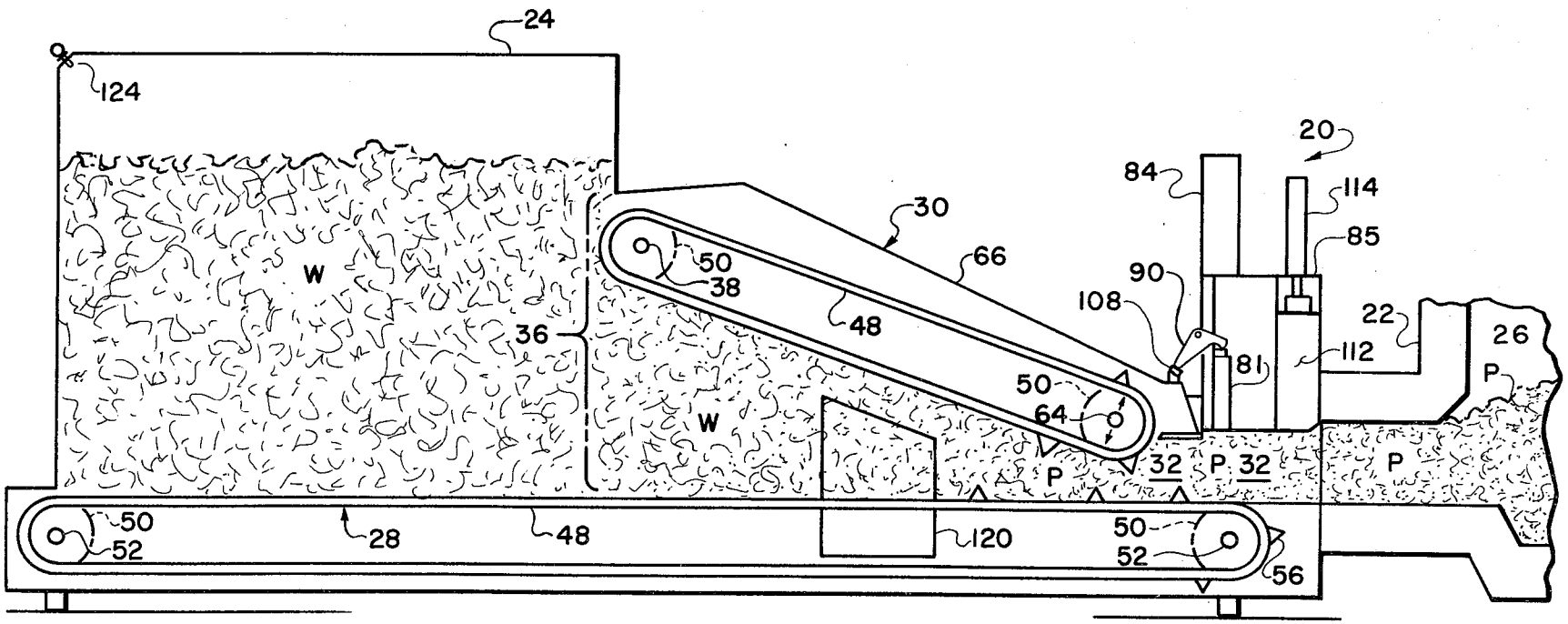
FIG. 1 is a side-elevational cross-sectional view of a compactor-feeder according to the present invention connected to an incinerator combustion chamber, taken generally along its longitudinal center line.

A compactor-feeder 20 according to the present invention is shown in FIG. 1 operationally connected to a typical package-unit incinerator 22. The feeder 20 is intended to transport solid waste W from a receiving hopper 24 to the combustion chamber 26 of the incinerator 22 while compacting the waste W between a lower conveyor 28 and a cooperating, movable, convergent upper conveyor 30. The solid line representations in FIG. 1 show the various elements in normal operating positions, and the broken line representations show other positions thereof as will be described hereinafter.

By their convergence, the conveyors 28 and 30 compact the waste W as they transport it, forming a continuous, traveling, compacted waste plug P therefrom. The conveyors 28, 30 force the waste plug P through an enclosed passageway 32 which confines the compacted waste from more than moderate expansion as it is forced to and through an entrance 34 to the combustion chamber 26, which may be adapted at its charging opening to mate with the compactor-feeder at the entrance 34.

The lower conveyor 28 traverses the bottom of the hopper 24, passing toward and through an exit 36 therefrom and extending toward the combustion chamber entrance 34. The upper conveyor 30 extends from the upper portion of the exit 36 over the lower conveyor 28 and convergent therewith toward the entrance 34, and it is pivotally mounted about its upper shaft 38 for movement of its convergent end 40 toward and away from the lower conveyor 28. The convergent end 40 is spaced from the combustion chamber entrance 34 to provide a fire break therebetween across which the waste plug P must pass through the passageway 32. In the absence of sufficient waste (a predetermined normal quantity thereof) thereunder, a mechanical lower stop (not shown) attached to the side member 44 of the feeder 20 supports the convergent end 40 at a suitable minimum spacing MS above the lower conveyor 28, at a position as indicated in broken lines at 40L, and a suitable similar upper stop (not shown) may be provided to limit the upward travel of the convergent end 40 to a position approximately as indicated in broken lines at 40H.

Figure 3:
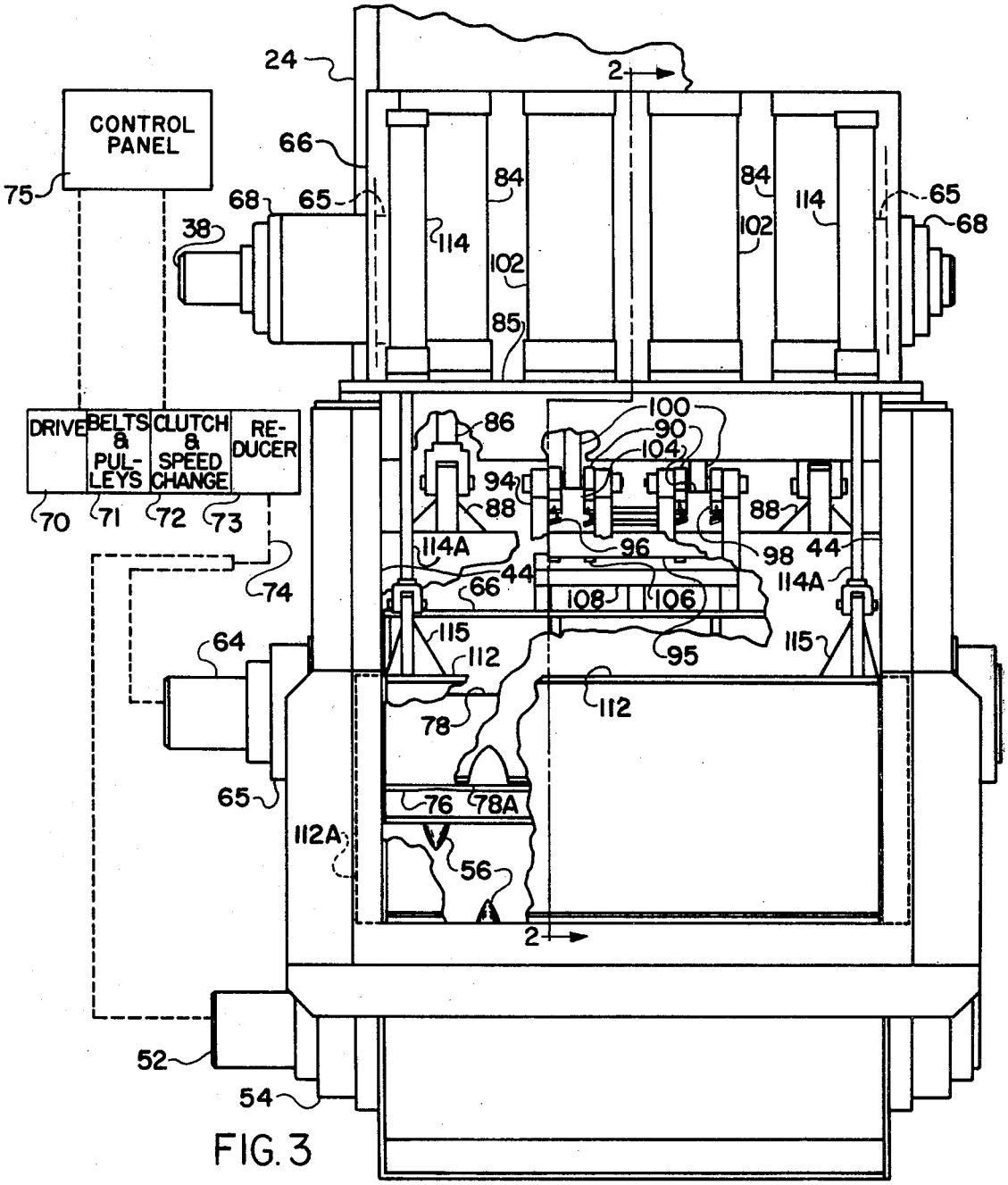
FIG. 3 is a partially broken-out, partially-schematic end view of the compactor-feeder and its drive and control elements taken along the line 3—3 of FIG. 2.

The conveyors 28 and 30 comprise a plurality of flights 46 mounted on endless chains 48 which are trained around sprockets 50 for drive and support. Lower conveyor 28 shafts 52 are conventionally mounted in bearings 54 conventionally mounted on the side members 44 of the feeder 20 typically as shown in FIG. 3. Each shaft 52 carries two or more sprockets 50 within the sides of the feeder 20 to support the chains 48 carrying the flights 46, whose ends are closely adjacent the side members 44 of the feeder 20. The upper conveyor 30 is similarly constructed.

Convexly conoid lugs 56 attached to the flights 46 at suitable spacings along the flights 46 and around the conveyors 28, 30 provide positive means of forcing the waste W along but are inherently self-cleaning due to their shape. Conventional support members 58 for the flights 46 of the lower conveyor 28 may be provided to support the lower reach thereof, suitably spaced across the feeder 20 to miss the lugs 56. Conventional roller tracks 60 may be provided to support the upper reaches of the chains 48 of the lower conveyor 28. Similar supports and tracks may be provided for the upper conveyor 30, upper roller tracks 62 being shown in FIG. 2.

A lower shaft 64 supports the chains 48 of the upper conveyor 30 at its convergent end 40, as does the shaft 38 at its upper end, and shafts 38 and 64 are carried conventionally in bearings 65 conventionally mounted at the sides of a frame 66 provided for the upper conveyor 30. The upper shaft 38 is also mounted in bearings 68 which are attached to the side members 44 conventionally to support the upper end of the conveyor 30 and to allow the convergent end 40 to pivot thereabout for its aforesaid movement toward and away from the lower conveyor 28.

Figure 2:
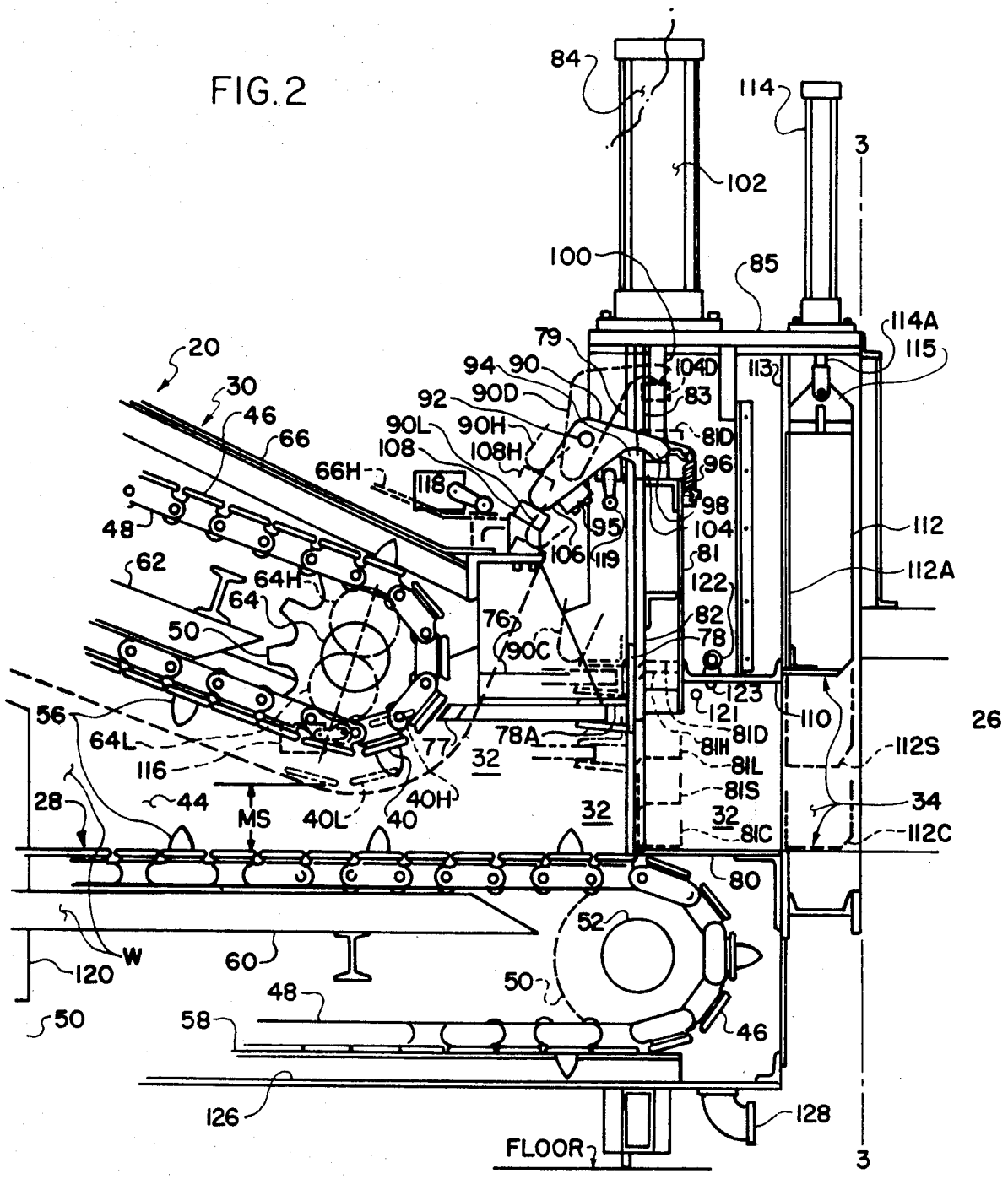
FIG. 2 is an enlarged broken out portion of FIG. 1 showing in more detail the convergence of the conveyors, the passageway from the conveyors to incinerator entrance, the firestop and fire door, and the operating elements therefor, all in normal operating positions, as well as broken line indications of other positions thereof.

Adjustable speed drive means 70 such as a nominal 1750 RPM full load speed DC electrical motor (not shown) whose speed is adjustable and rotation reversible within a high range covering 80–100% of full load speed and a low range covering 5–20% of full load speed by means of a Fincor Controller (Income International Inc.) (not shown) connected thereto, is provided for the conveyors 28 and 30 and is shown in FIG. 3 in schematic form connected by belts and pulleys 71 (shown schematically) to a conventional clutch and speed change apparatus 72, such as a Turner Unidrive (Turner Mfg. Co.) (shown schematically) which provides clutches and gearing for selectively transmitting drive power at a 1:1 or a 4:1 reduction ratio. The apparatus 72 is further connected to and through a 121:1 gear reducer 73 and sprockets, chains, and gears 74 (shown schematically) to the shaft 64 of the conveyor 30 and the shaft 52 of the conveyor 28 nearest the incinerator 22 so that, in normal operation and as shown in FIG. 2, shafts 52 turn clockwise and shaft 64 counterclockwise. The shafts 52 and 64 can thus be driven at a normally relatively low speed, and can be changed to a relatively high speed (as low as about 0.03 RPM or as high as about 2.5 RPM), an additional 6:1 reduction and the reverse directions of rotation between the shafts 52 and 64 being provide by the belts and pulleys 71 and the sprockets, chains, and gears 74. A control panel 75 is connected to the drive means 70 and the clutch and speed change apparatus 72 for controlling the operation and speed of the drive means 70 both forward and reverse, and of the clutch and speed change apparatus 72 for selective operation at the aforesaid low or high speeds.

The drive means 70 may be a conventional adjustable speed apparatus, whether electrically, mechanically, or hydraulically controlled, but preferably driven by an electric motor as aforesaid. The clutch and speed change apparatus 72 may likewise be of conventional construction, preferably an electrically controlled clutch which selectively causes driving through either of two sets of gears or the like having different reduction ratios, preferably having a relation of about 4:1 for the present invention, but may be of any suitable construction. The control panel 75 is preferably an electrical relay type control panel, providing for receiving various signals from the apparatus and from manually operated switches and using those signals to control the drive means 70, the clutch and speed change apparatus 72, and other functions of the apparatus as explained hereinafter. The elements 70, 71, 72, 73, 74, and 75 being of conventional construction and forming no part of the present invention, are shown schematically, as anyone skilled in the art could readily duplicate their functions from commercial equipment.

The enclosed passageway 32 is formed at the sides by the side members 44 of the compactor-feeder 20, which extend to the combustion chamber entrance 34. The upper or roof portion of the passageway 32 is formed first by a pressure plate 76 which is affixed to the frame 66 of the upper conveyor 30 and extends generally horizontally beyond the convergent end 40 of the conveyor 30 at a level somewhat higher than the lowest part of the conveyor 30. The pressure plate 76 has an angled, doctor blade edge 77 disposed in doctoring relation to the curved path of the conveyor flights 46 as they move around the sprockets 50 at the convergent end 40 of the conveyor 30 to insure that the compacted waste W is separated from the conveyor 30 after passing the low point thereof and that the waste W is confined to form the aforesaid compacted waste plug P in cooperation with the lower conveyor 28 which extends beyond the convergent end 40 of the upper conveyor 30 toward the combustion chamber entrance 34. The plate 76 is preferably disposed so that it allows the compacted waste W to expand upwardly about 50 percent by volume after leaving the low point of the upper conveyor 30.

A baffle plate 78 disposed vertically just beyond the extending end of the pressure plate 76 is movable vertically in slots 79 disposed in the side members 44 into which it extends. The plate 78 has a bifurcated foot 78A which vertically straddles the extending end of the pressure plate 76 and is of suitable length for engagement thereof at all points in the limits of the arcuate travel of the plate 76 about the upper shaft 38. The baffle plate 78 thereby moves up and down with the pressure plate 76, the bottom of the foot 78A effectively forming an extension of the underside of the plate 76 while the bifurcation of the foot 78A telescopes with the extending end of the plate 76 during its arcuate movement. The bottom of the foot 78A forms an additional roof portion of the passageway 32.

A floor plate 80 is disposed in doctoring relation to the upper reach of the lower conveyor 28 generally at the point where the lower conveyor flights 46 start their curved path around the lower conveyor sprockets 50, the plate 80 having an angled edge disposed closely adjacent the path of the flights for doctoring the conveyor. The plate 80 forms a floor portion of the passageway 52 beyond the lower conveyor 28 and assures that the traveling waste plug P is confined on its lower side as it passes from the conveyor 28 to the combustion chamber entrance 34 at which the floor plate 80 is attached and ends.

Just beyond the baffle plate 78 and closely adjacent thereto is a firestop 81 in the form of a vertically sliding door extending between the side members 44 and engageable with the upper conveyor 30 for movement therewith, the lower portion of the firestop 81 being generally at the same level as the underside of the pressure plate 76 during such engagement and thereby forming an additional roof portion of the passageway 32. The firestop 81 may be selectively disengaged from the conveyor 30 and may then be moved downwardly so that its lower portion will seal against the floor plate 80 at the end thereof adjacent the lower conveyor 28 (as shown in broken lines at 81C) in the absence of waste W in the passageway 32. The backplate 82 of the firestop 81 extends laterally into vertical guide slots 83 provided in the side walls 44 for guidance of the firestop 81, and the lower edge of the backplate 82 may be sharpened, serrated, and extended somewhat below the underside of the firestop 81 for mating engagement with the doctoring edge of the floorplate 80 in the absence of waste W thereunder or for biting into waste W thereunder when the firestop 81 is disengaged from the conveyor 30.

The firestop 81 is vertically movable by firestop air cylinders 84 controlled by a solenoid valve (not shown) connected to the control panel 75 for control thereby and mounted on the framework 85 of the compactor-feeder 20, and their piston rods 86 are shown attached to brackets 88 of the firestop 81 in FIG. 3. Normally the firestop 81 is engaged with the conveyor 30 by means of the engagement fingers 90 (as shown in FIGS. 2 and 3) pivoted on a pin 92 which is carried in the support brackets 94 which are attached to the firestop 81. A tiebar 95 extends across and is fastened to the fingers 90 so that they will move as one, and they are biased in a clockwise direction as shown in FIG. 2 by the springs 96 attached between the actuating ends 98 thereof and the firestop 81. As shown in FIG. 3, the fingers 90 are disposed in pairs, each pair straddling the piston rod 100 of a biasing cylinder 102 (controlled similarly to the cylinder 84) also mounted on the frame 85 of the compactor-feeder 20 and bearing against the upper face of a mushroom head 104 attached to the end of the piston rod 100 for bearing at the lower face thereof against the top of the firestop 81. Thus, when the mushroom head 104 is in contact with the top of the firestop 81, the springs 96 bias the fingers 90 toward their solid line positions as shown in FIG. 2, so that downward pressure on the firestop 81 from the cylinders 84 and 102 causes the engaging ends 106 of the fingers 90 to bear against an engagement bar 108 which is fixed to the frame 66 of the upper conveyor 30 beyond its convergent end 40.

If sufficient waste W is present under the conveyor 30 during operation thereof, the compacted waste will support the conveyor 30, and by means of the fingers 90 will also support the firestop 81 against the pressure exerted by the cylinders 84 and 102, so that the lower portion of the firestop 81 in effect forms a continuation of the pressure plate 76 while a normal or sufficient quantity of waste W is transported by the conveyors 28 and 30, all as shown in solid lines in FIG. 2. A roof plate 110 extending between the side members 44 at the approximate level of the top of the combustion chamber entrance 34 fills the space between the firestop 81 and the entrance 34 to form the final roof portion of the enclosed passageway 32.

The entrance 34 is essentially an extension of the passageway 32 and extends therefrom to connect to the combustion chamber 26. The bottom and sides of the entrance 34 are stationary, but, when the entrance 34 is open, the roof portion thereof is the lower portion of a fire door 112 located thereabove and constructed largely of refractory material but having a metal back plate 112A which extends laterally into vertical guide slots 113 provided in the sides of the entrance 34. The door 112 is movable vertically in the slots 113 and may be held in an upper position (as shown in solid lines in FIG. 2) by fire door air cylinders 114 (controlled similarly to the cylinder 84 and also mounted on the framework 85) whose piston rods 114A are connected to attachment brackets 115 fixed to the upper portion of the door 112. As desired, and explained hereinafter, the fire door 112 may be lowered by the cylinders 114, in the absence of waste W thereunder, to a lower position as indicated in broken lines at 112C for closing the entrance 34 completely, or to any intermediate position (as representatively indicated in broken lines 112S in FIG. 2) for compression of any waste W or waste plug P thereunder to seal the entrance 34 against fire from the combustion chamber 26 getting to any waste in the passageway 52 or farther back in the apparatus.

In the absence of sufficient waste W under the conveyor 30 and in the passageway 32, pressure from the cylinders 84 and 102 will force the convergent end 40 of the conveyor 30 downwardly by means of the fingers 90. A lower limit switch 116 as shown schematically in FIG. 2 is connected to the control panel 75 and is disposed conveniently on a side member 44 for contact and actuation by the lower shaft 64 of the conveyor 30 when the conveyor 30 is forced downwardly to the vicinity of its lower stop, such shaft position being indicated in broken lines at 64L. A similar upper limit switch 118 also connected to the control panel 75 is provided for actuation by the conveyor frame 66 if the conveyor 30 should be raised to the vicinity of its upper stop, such frame 66 position being indicated in broken lines at 66H. Actuation of switch 116 or 118 signals the detection of discontinuance of transporting the predetermined normal quantity of waste which is intended to support the conveyor 30 between them.

The switch 116 is connected to the control panel 75, and its actuation signals the panel 75 to cause the cylinders 102 to retract the mushroom heads 104 to move the actuating ends 98 of the engagement fingers 90 counterclockwise to disengage their engaging ends 106 from the bar 108 so that the fingers 90 assume an angular position as representatively shown at 90D in FIG. 2, thereby actuating a latch limit switch 119 (also connected to the panel 75) which is suitably mounted on the firestop 81 for contact by the tiebar 95 which moves with the fingers 90. Actuation of the switch 119 enables the circuitry of the panel 75 to cause the engagement fingers 90 to be returned to their most clockwise position as shown in solid lines in FIG. 2 for re-engagement with the conveyor 30 after such prior disengagement therefrom and also enables returning the conveyors 28 and 30 to low speed and raising the fire door after such re-engagement, as will be mentioned variously hereinafter.

Upon such disengagement, the cylinders 84, which have continued to push downwardly on the firestop 81, immediately lower it to its lowermost position as indicated in broken lines at 81C in FIG. 2 (unless stopped sooner by waste W thereunder) to seal off the passageway 32, since the cylinders 84 exert more force in the downward direction than the cylinders 102 exert in the upward direction. The mushroom heads 104 of the cylinders 102 remain retracted and the engagement fingers 90 remain clear of the upper conveyor 30 while the weight of the conveyor 30 on the lower shaft 64 holds the limit switch 116 actuated. Actuation of the limit switch 116 also signals the control panel 75 to cause the drive means 70 and the clutch and speed change apparatus 72 to drive the conveyors 28 and 30 at their higher speeds, and to cause the fire door 112 to be lowered to close the entrance 34 to the combustion chamber 26. Both the firestop 81 and the fire door 112 are caused by the control panel 75 to continue to be forced downwardly against the waste plug P so long as the switch 116 is actuated, so that if the waste in the plug P begins to char or burn from the heat in the combustion chamber, the door 112 and the firestop 81 will continue to close down on the burned or charred waste for sealing off the combustion chamber 26 from the waste on the conveyor 28 and in the hopper 24, and sealing off any combustion in the passageway 32 between the firestop 81 and the fire door 112 therefrom.

The preceding sequence of events having occurred in response to insufficient waste under the upper conveyor 30, the higher speed of the conveyors 28 and 30 should result in an increased flow of waste W from the hopper 24, and upon its arrival under the conveyor 30 and in the passageway 32 against the firestop 81, the waste W should soon accumulate and be compacted sufficiently to overcome the weight of the extending convergent end 40 of the conveyor 30 (which weight is holding the convergent end 40 downwardly and actuating the limit switch 116) so that the convergent end 40 will be raised by the accumulated waste W and the limit switch 116 will no longer be actuated. Such deactuation of the limit switch 116 signals the control panel 75 to retract the piston rods of the cylinders 84 to raise the firestop 81 to its uppermost position as indicated at 81D in FIG. 2, and, after a brief time delay period generated in the panel 75, to cause the mushroom heads 104 to be extended, thereby allowing the fingers 90 to resume their most clockwise, engaging positions as biased thereto by the springs 96 and representatively shown at 90 in FIG. 2, and to cause extension of the piston rods 86 of the firestop air cylinders 84 to cause the firestop 81 to move downwardly, thereby re-engaging the fingers 90 with the engagement bar 108 of the conveyor 30 and thereby biasing the conveyor 30 downwardly against the waste W thereunder for normal support thereby.

Thereafter, the control panel 75, after a time delay period generated therein, such as 10 seconds, causes the fire door 112 to be opened by the cylinders 114, and causes the drive 70 and the clutch and speed change apparatus 72 to shift the conveyors 28 and 30 back to their normal slower rates of travel for transporting the compacted waste W out of the hopper 24 through the conveyors 28 and 30 and forcing the compacted plug of waste P formed thereby through the passageway 32 and through the combustion chamber entrance 34 into the combustion chamber 26 at a feed rate suitable for causing combustion of the waste W in the combustion chamber 26 at a generally steady rate consistent with a predetermined constant flow of air thereto. The adjustable speed drive means 70 having been previously manually adjusted to cause the conveyors 28 and 30 to travel at such a predetermined normal feed rate, and the pressure on the air cylinders 84 and 102 having been adjusted so that a predetermined quantity of waste W being compacted under the conveyor 30 will hold the conveyor 30 up off the limit switch 116 against the pressure of the cylinders 84 and 102, a suitable plug of waste P is thereby formed and fed to the combustion chamber 26 for causing the aforesaid steady rate of combustion.

If, on occasion, the type or quantity of waste in the hopper 24 should cause the conveyors 28 and 30 to transport a quantity or object of waste W which is insufficiently compactable for passage through the compactor-feeder 20 into the combustion chamber 26, the upper limit switch 118 is connected to the control panel 75 and disposed on the side member 44 for contact and actuation by the frame 66 when the insufficiently compactable waste W causes the conveyor 30 to rise upwardly against the pressure of the cylinders 84 and 102 to the positions of the frame 66 and the convergent end 40 as indicated in broken lines at 66H and 40H in FIG. 2. Such actuation of the limit switch 118 signals the panel 75 to cause the drive means 70 to go into reverse and the drive means 70 and the clutch and speed change apparatus 72 to shift into their higher speed ranges for clearing the waste W backwardly from the conveyors 28 and 30, and at the same time the panel 75 actuates the cylinders 102 to retract the heads 104 for disengaging the fingers 90 and thereby dsengages the firestop 81 from the conveyor 30, thereby relieving the downward bias on the conveyor 30, and causing the firestop 81 to move downwardly toward its lowermost position as indicated in FIG. 4 at 81C. At the same time, the fire door 112 is caused to move downwardly by the panel 75 toward its fully closed position as indicated at 112C in FIG. 4.

The pressure exerted by cylinders 84 on the firestop 81 further locally and concentratedly compacts and compresses the plug of waste P thereunder, and at least a portion of the waste W thereunder may be withdrawn from thereunder by the reverse motion of the conveyors 28 and 30, allowing still farther compaction and compression thereof. However, the firestop 81 and the lower edge of its backplate 82 act to prevent burning waste withdrawal back toward the hopper 24 from the combustion chamber 26, and the pressure exerted downwardly on the fire door 112 by the cylinders 114 likewise further locally compacts the plug of waste P under the door 112 and similarly prevents waste from being withdrawn thereunder.

Upon suitable clearing of the insufficiently compactable waste W from the conveyors 28 and 30 by their reverse travel, the conveyor 30 will again move of its own weight downwardly toward the conveyor 28 and will thereby deactuate the upper limit switch 118, thus signalling the control panel 75 of such clearing, and the panel 75 will act similarly as previously for deactuation of the switch 116 to cause the cylinders 84 to raise the firestop 81 for re-engagement with the conveyor 30 and to cause the conveyors 28 and 30 to transport waste W in the feeding direction toward the combustion chamber 26 at their higher speeds while biasing the conveyor 30 downwardly and maintaining the firedoor 112 in its downwardly biased condition during a time delay period such as 10 seconds (as previously mentioned). At the end of the 10 second delay, if the switch 118 is not reactuated therebefore, the panel 75 causes the conveyors 28 and 30 to run again at their slower speeds and the fire door 112 to be raised to its open position for normal transporting and feeding. If the previously insufficiently compactable waste W persists in that condition and is advanced sufficiently into the convergence of the conveyors 28 and 30 during the 10 second delay period, the switch 118 will be reactuated, and the process of lowering the firestop 81 and reversing the conveyors 28 and 30 as described in the two preceding paragraphs will be repeated without ever raising the fire door 112.

If the waste W continues insufficiently compactable, the reversing cycle as just described will be automatically repeated indefinitely until such repeated reversals disturb the waste W sufficiently that suitable compaction of the waste which was previously incompactable can be achieved normally and normal feeding will automatically ensue in the absence of actuation of the switch 118, or until a visual signal or an audible alarm (which are connected to and automatically activated by the control panel 75 while the conveyors 28 and 30 are traveling in reverse) causes an attendant to manually remove or break up the incompactable waste through an access door 120 which is provided in at least one of the side members 44.

Since the waste W is subject to smoldering, creeping combustion even where extremely compacted locally under the firestop 81 and the firedoor 112, a thermocouple or temperature sensor 121 has been provided in the upper portion of the passageway 32 for detecting a fire therein by monitoring the temperature therein. The sensor 121 is connected through the control panel 75 for actuating a solenoid valve (not shown) connected to a pipe 122 which supplies water to spray nozzles 123 also provided in the passageway 32 for flooding and extinguishing any such fire. Additional spray nozzles 124 are provided at the rear lip of the hopper 24 for extinguishing any fires which may occur therein, whether of external origin, or should fire creep back to the hopper 24 from the incinerator 22 in spite of the safety elements incorporated in the compactor-feeder 20. A drip pan 126 disposed beneath the compactor-feeder 20 is provided to collect any such water sprayed, or to collect any drippings from the compacted waste, and a drain connection 128 is provided for pumping or piping such collected fluid away from the compactor-feeder 20.

The status of various elements of the apparatus may be indicated by signal lights (not shown) disposed on the control panel 75 and connected suitably thereto for such indications, such as lights which indicate that electrical power is being supplied to the apparatus, that the firestop 81 is up, that the fire door 112 is up, that the conveyors 28 and 30 are traveling in reverse or at high speeds as previously mentioned, that the conveyors 28 and 30 are traveling in the feeding direction, that the thermocouple or temperature sensor 121 in the passageway 32 has sensed excessive heat thereat and actuated the fire extinguisher nozzles 123 therefor, or other conditions which it may be desirable to monitor.

In operation, with power supplied to the controller 75 and its selector switches (not shown) set for running automatically, pushing a start button (not shown) without waste W in the hopper 24 will cause the conveyors 28 and 30 to travel in feeding direction toward the incinerator 22 at the higher speed provided, since the upper conveyor 30 will be resting of its own weight on its lower stops (not shown), thereby actuating the limit switch 116 which acts through its connection to the control panel 75 to cause such high speed operation and allow the firestop 81 and fire door 112 to remain fully closed as from the previous shut down. Introduction of sufficient waste W into the hopper 24 will then automatically result in formation and feeding of the aforesaid waste plug P into the incinerator combustion chamber 26 at the normal slower rate of travel, subject to the automatic speeding up of the conveyors 28 and 30 and attendant actions as aforesaid upon actuation of the switch 116 due to insufficient waste W under the conveyor 30, and automatic reversal thereof and attendant actions as aforesaid upon actuation of the switch 118 due to insufficiently compactable waste W under the conveyor 30.

If it is desired to stop feeding waste to the compactor-feeder 20, suitable manual controls (not shown) are provided on the panel 75 for shutting down the conveyors 28 and 30, and upon such cessation of waste transporting, the control panel 75 automatically causes the firestop 81 and the fire door 112 to close down against the compacted waste plug P thereunder. Further manual controls (not shown) on the panel 75 provide for reversing the conveyors 28 and 30 briefly ("jogging") before restarting in order to transport at least some of the waste W backwardly to allow time for the firestop 81 and the fire door 112 to reopen (as described hereinbefore) before again transporting the waste plug P therepast after restarting the cnveyors 28 and 30. An additional manual control (not shown) on the panel 75 provides for raising both the firestop 81 and the fire door 112 to their highest positions as at 81D and 112 in FIG. 2 for cleaning, maintenance, or other purposes. A manual control (not shown) for "jogging" the conveyors 28 and 30 in forward direction is also provided.

If the conveyors 28 and 30 are to be shut down for a prolonged period of time, it is desirable to briefly reverse them as just described immediately after shutting them down, thereby dragging at least part of the compacted waste plug P from the vicinity of the firestop 81 for more effectively preventing fire from the combustion chamber 26 from reaching the waste W in the hopper 24 during the period of the shutdown by disrupting the plug P and thereby allowing further closing of the firestop 81 as previously described. In addition, a manual control (not shown) is provided for signaling the panel 75 to cause extension of the piston rods 100 of the biasing cylinders 102 so that their additional pressure on the firestop 81 will cause further compression of any waste W thereunder for better sealing off the passageway 32.

If a power failure should occur, the control panel 75 and the solenoid valves (not shown) connected thereto for controlling the cylinders 84, 102, and 114 will immediately act under air pressure automatically held in a pressure vessel (not shown) associated conventionally with the compactor-feeder 20 to disengage the firestop 81 from the conveyor 30 and to close both the firestop 81 and the fire door 112 to seal off the passageway 32 from fire in the combustion chamber 26 as previously described.

The present combination of structure and operating and control elements is intended to continuously feed loose combustible waste from a hopper to the combustion chamber of an incinerator at a predetermined steady rate which will result in a steady rate of combustion with the predetermined constant supply of air to the incinerator for maximum practical efficiency of such combustion and minimum practical air pollution therefrom. A minimum of operator or supervisory attention will be required, since the present compactor-feeder provides for automatic methods for providing remedies for conditions such as running low on waste or encountering waste difficult or impossible to compress, and can provide alarms or signals for calling attention to any failure of such remedies. The present compactor-feeder also provides for automatic methods of sealing off incoming waste from the fire in the incinerator whether in normal operation, automatic remediation, or shutdown condition, and the incinerator entrance is sealed as well against entry of air which might disturb the desired combustion conditions therein. Such apparatus and methods are unknown in the prior art and should provide highly advantageous improvements in the economy, efficiency, and safety of waste heat recovery from combustible waste materials.

The particular embodiment disclosed in full detail herein and illustrated in the drawings has been provided for disclosure purposes only, and is not intended to limit the scope of the present invention, which is to be determined by the scope of the appended claims.

We claim:

1. Compactor-feeder apparatus for a solid waste incinerator having a waste combustion chamber with a firebed therein and an entrance thereto communicating with the firebed comprising:

(a) a waste receiving hopper having an exit spaced from said combustion chamber entrance;

(b) lower conveyor means traversing the bottom of said hopper for transporting waste therefrom through said exit toward said combustion chamber entrance;

(c) upper conveyor means disposed above said lower conveyor means and extending convergently with said lower conveyor means toward said combustion chamber entrance for cooperating with said lower conveyor means for compacting said waste and forcing it into said combustion chamber to feed said firebed a continuous plug of compacted waste, said upper conveyor means having a convergent end mounted in spaced relation above said lower conveyor means, and said convergent end being spaced from said combustion chamber entrance to provide a fire break therebetween;

(d) an enclosed passageway from said convergent end of said upper conveyor means to said combustion chamber entrance for confining the compacted waste as it is being forced therethrough by said upper and lower conveyor means into said combustion chamber;

(e) a movable fire door selectively operable to open and close said combustion chamber entrance; and (f) firestop means disposed at said passageway at a spacing from said combustion chamber entrance and selectively movable transversely in said passageway for opening of said firestop means for the compacted waste to be forced through said passageway, and for closing of said firestop means against the compacted waste therein with said firestop means imposing further concentrated localized compacting thereof, said firestop means being movable to completely close said passageway in the absence of waste therein, said firestop thereby serving to seal the waste in the hopper and between said conveyor means from any combustion occurring in the passageway between said firestop and fire door.

2. Compactor-feeder apparatus according to claim 1 and characterized further by means for moving said movable firestop means.

3. Compactor-feeder apparatus according to claim 2 and characterized further by means for causing said firestop opening when said conveyor means is transporting a predetermined quantity of waste.

4. Compactor-feeder apparatus according to claim 3 and characterized further by means for causing said conveyor means to travel at a predetermined normal rate after said firestop opening.

5. Compactor-feeder apparatus according to claim 4 and characterized further in that said means for causing said conveyor means to travel is operable to adjust said predetermined normal rate.

6. Compactor-feeder apparatus according to claim 5 and characterized further in that said normal rate is suitable for causing combustion of said waste in said combustion chamber at a generally steady rate.

7. Compactor-feeder apparatus according to claim 4 and characterized further in that said means for moving said firestop means comprises means for selectively positioning said firestop means open and closed against said compacted waste.

8. Compactor-feeder apparatus according to claim 4 and characterized further by means for causing said firestop means to be closed against said compacted waste for closing off said passageway when said conveyor means is transporting less than a predetermined quantity of waste.

9. Compactor-feeder apparatus according to claim 8 and characterized further by means for causing said conveyor means to travel at a predetermined relatively high rate when said conveyor means is transporting less than a predetermined quantity of waste.

10. Compactor-feeder apparatus according to claim 4 and characterized further by reversing means for causing said conveyor means to reverse and travel in reverse at a predetermined relatively high rate in response to transport of a quantity or object of waste insufficiently compactable for suitable passage through said apparatus into said combustion chamber, thereby clearing said conveyor means of said quantity or object sufficiently to end said response.

11. Compactor-feeder apparatus according to claim 10 and characterized further by means for causing said firestop means to be closed against said compacted waste for closing off said passageway in response to said transport of said quantity or object insufficiently compactable.

12. Compactor-feeder apparatus according to claim 11 and characterized further in that said reversing means comprises means for causing said conveyor means to again travel in feeding direction upon said clearing.

13. Compactor-feeder apparatus according to claim 12 and characterized further by means for again causing said firestop opening upon said clearing.

14. Compactor-feeder apparatus according to claim 1 and characterized further by a pressure plate having an end disposed adjacent said upper conveyor means in doctoring relation thereto.

15. Compactor-feeder apparatus according to claim 14 and characterized further in that said pressure plate is disposed in fixed relation to said upper conveyor means.

16. Compactor-feeder apparatus according to claim 15 and characterized further in that said pressure plate forms an upper portion of said passageway.

17. Compactor-feeder apparatus according to claim 1 and characterized further by means for selectively causing said movable fire door to move to an open position when said waste is being forced into said combustion chamber and to close under pressure against said compacted waste when said conveyor means stop, operate in reverse, or transport less than a predetermined quantity of waste, said door being movable to completely close said combustion chamber entrance in the absence of waste thereunder.

18. Compactor-feeder apparatus according to claim 1 and characterized further by a floor plate for said passageway disposed in doctoring relation to said lower conveyor means between said lower conveyor and said combustion chamber entrance.

19. Compactor-feeder apparatus according to claim 1 and characterized further by means for extinguishing fire in said passageway.

20. Compactor-feeder apparatus according to claim 19 and characterized further by temperature sensor means for said passageway for activating said extinguishing means.

21. Compactor-feeder apparatus according to claim 1 and characterized further in that said upper conveyor means is movable and is mounted for movement of at least said convergent end toward and away from said lower conveyor means, and by means for biasing said upper conveyor means downwardly for said compacting.

22. Compactor-feeder apparatus according to claim 21 and characterized further by means for moving said movable firestop means which includes said means for biasing.

23. Compactor-feeder apparatus according to claim 22 and characterized further by means for selectively engaging said biasing means with said upper conveyor means for said compacting said waste.

24. Compactor-feeder apparatus according to claim 23 and characterized further by means for causing said firestop opening and said engaging and biasing when said conveyor means is transporting a predetermined quantity of waste.

25. Compactor-feeder apparatus according to claim 24 and characterized further by means for causing said conveyor means to travel at a predetermined normal rate after said engaging and biasing.

26. Compactor-feeder apparatus according to claim 25 and characterized further in that said means for moving said firestop means comprises means for selectively positioning said firestop means open and closed against said compacted waste.

27. Compactor-feeder apparatus according to claim 26 and characterized further by means for causing said biasing means to disengage from said upper conveyor means and said firestop means to be closed against said compacted waste for closing off said passageway when said conveyor means is transporting less than a predetermined quantity of waste.

28. Compactor-feeder apparatus according to claim 25 and characterized further by reversing means for causing said conveyor means to reverse and travel in reverse at a predetermined relatively high rate in response to upward movement to a predetermined position of said upper conveyor means caused by transport of a quantity or object of waste insufficiently compactable by said biasing for suitable passage through said apparatus into said combustion chamber, thereby clearing said conveyor means of said quantity or object sufficiently to allow said upper conveyor means to move downwardly from said predetermined position.

29. Compactor-feeder apparatus according to claim 28 and characterized further by means for causing said biasing means to disengage from said upper conveyor means and for causing said firestop means to be closed against said compacted waste for closing off said passageway in response to said upward movement.

30. Compactor-feeder apparatus according to claim 29 and characterized further in that said reversing means comprises means for causing said conveyor means to again travel in feeding direction upon said clearing.

31. Compactor-feeder apparatus according to claim 30 and characterized further by means for again causing said firestop opening and said engaging and biasing upon said clearing.

32. A method of generally continuously feeding waste from a hopper to the firebed of a waste combustion chamber for combustion therein and preventing fire from reaching said hopper comprising the steps of:

(a) transporting a predetermined normal quantity of said waste from said hopper toward said combustion chamber and compacting said waste during said transporting, said transporting normally forcing the compacted waste through a confining passageway to an entrance to said combustion chamber as a continuous plug of compacted waste, thereby sealing said entrance and preventing fire from said combustion chamber from reaching said waste in said hopper during said feeding;

(b) detecting a discontinuance of said transporting of said normal waste quantity;

(c) closing a firestop on said plug in said passageway at a distance from said combustion chamber entrance in response to said detecting; and (d) closing a fire door on said plug at said combustion chamber entrance in response to said detecting, said firestop and fire door closing causing further localized compacting of said plug under said firestop and fire door for for preventing fire from passing beyond said firestop in the direction of said hopper during said discontinuance.

33. A method of feeding waste to a combustion chamber according to claim 32 and characterized further in that said transporting occurs at a first predetermined rate of travel and said firestop and fire door closings occur upon transporting of less than said predetermined normal quantity of waste.

34. A method of feeding waste to a combustion chamber according to claim 33 and characterized further in that said first predetermined rate of travel is adjustable.

35. A method of feeding waste to a combustion chamber according to claim 34 and characterized further in that said first predetermined rate of travel is adjusted for a generally steady rate of said combustion.

36. A method of feeding waste to a combustion chamber according to claim 33 and characterized further by an additional step of:

(e) transporting waste from said hopper toward said combustion chamber at a second higher rate of travel upon said transport of less than said predetermined normal quantity of waste.

37. A method of feeding waste to a combustion chamber according to claim 36 and characterized further by an additional step of:

(f) opening said firestop from said plug upon again transporting said predetermined normal quantity of waste after said closings.

38. A method of feeding waste to a combustion chamber according to claim 37 and characterized further by the additional step of:

(g) opening said fire door from said plug and reverting to transporting said waste at said first rate of travel at a predetermined time after said opening of said firestop.

39. A method of feeding waste to a combustion chamber according to claim 32 and characterized further in that said transporting occurs at a first predetermined rate of travel, and said firestop and fire door closings occur upon detecting such a discontinuance comprising transporting of a quantity or object of waste insufficiently compactable for normal forcing through said passageway.

40. A method of feeding waste to a combustion chamber according to claim 39 and characterized further by an additional step of:

(e) reversing the direction of said transporting upon detecting said transporting said insufficiently compactable waste, said firestop and fire door closings preventing dragging of burning waste from said combustion chamber by said reversing.

41. A method of feeding waste to a combustion chamber according to claim 40 and characterized further in that such reverse transporting occurs at a higher rate of travel than said first predetermined rate and continues until said insufficiently compactable waste is cleared from said detecting, and by an additional step of:

(f) again transporting said waste toward said combustion chamber, but at a second, higher rate of travel, when said insufficiently compactable waste is so cleared.

42. A method of feeding waste to a combustion chamber according to claim 41 and characterized further by an additional step of:

(g) opening said firestop from said plug upon transport of said predetermined normal quantity of waste again after said closings.

43. A method of feeding waste to a combustion chamber according to claim 42 and characterized further by an additional step of:

(h) opening said fire door from said plug and reverting to transporting said waste at said first rate of travel at a predetermined time after said opening of said firestop.

44. A method of feeding waste to a combustion chamber according to claim 43 and characterized further by an additional step of:

(i) sounding an audible alarm during such reverse direction transporting.

45. A method of feeding waste to a combustion chamber according to claim 43 and characterized further by continuing repetition of steps (e) through (h) until said incompactable waste is removed or said repetition causes suitable compaction of said previously incompactable waste for resumption of said transporting of said normal quantity.

46. A method of feeding waste to a combustion chamber according to claim 32 and characterized further by an additional step of:

(e) shutting down said transporting and closing said firestop and fire door against said compacted waste.

47. A method of feeding waste to a combustion chamber according to claim 46 and characterized further by an additional step of:

(f) briefly reversing said transporting prior to restarting said transporting toward said combustion chamber after said shutting down thereof, to allow time for said firestop and fire door to be respectively opened before again transporting said compacted waste plug respectively therepast after said restarting.

48. A method of feeding waste to a combustion chamber according to claim 46 and characterized further by an additional step of:

(f) briefly reversing said transporting after said shutting down thereof, when said shutting down is intended for a prolonged period, for dragging at least part of said compacted waste plug from the vicinity of said firestop for more effectively preventing fire from said combustion chamber from reaching said waste in said hopper during the period of shutdown by disrupting said continuous plug of waste and allowing farther closing of said firestop.

49. A method of feeding waste to a combustion chamber according to claim 32 and characterized further by an additional step of:

(e) detecting fire in said passageway by means for monitoring the temperature therein.

50. A method of feeding waste to a combustion chamber according to claim 49 and characterized further by an additional step of:

(f) extinguishing such fire through actuation by said monitoring means of fire extinguishing means located in said passsageway.

51. A method of feeding waste to a combustion chamber according to claim 32 and characterized further in that said compacting is done under predetermined bias.

52. A method of feeding waste to a combustion chamber according to claim 51 and characterized further in that said transporting occurs at a first predetermined rate of travel, and said firestop and fire door closings occur upon detecting such a discontinuance comprising transporting of a quantity or object of waste insufficiently compactable under said bias for normal forcing through said passageway.

* * * * *